US012005938B2

(12) United States Patent
Bleth et al.

(10) Patent No.: US 12,005,938 B2
(45) Date of Patent: Jun. 11, 2024

(54) CATCHING DEVICE FOR A SHUNT COUPLING

(71) Applicant: Siemens Mobility GmbH, Munich (DE)

(72) Inventors: Sebastian Bleth, Munich (DE); Jörg Melde, Olching (DE); Jörg Pforr, Moosach (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/263,747

(22) PCT Filed: Dec. 14, 2021

(86) PCT No.: PCT/EP2021/085691
§ 371 (c)(1),
(2) Date: Aug. 1, 2023

(87) PCT Pub. No.: WO2022/161690
PCT Pub. Date: Aug. 4, 2022

(65) Prior Publication Data

US 2024/0034369 A1 Feb. 1, 2024

(30) Foreign Application Priority Data

Feb. 1, 2021 (DE) ..... 10 2021 200 863.1

(51) Int. Cl.
*B61G 7/14* (2006.01)
*B61J 99/00* (2006.01)

(52) U.S. Cl.
CPC ..... *B61J 99/00* (2013.01); *B61G 7/14* (2013.01)

(58) Field of Classification Search
CPC ..... B61G 7/14; B61J 99/00
See application file for complete search history.

(56) References Cited

U.S. PATENT DOCUMENTS 3,633,514 A * 1/1972 Deike ..... B61J 3/12 105/72.2

FOREIGN PATENT DOCUMENTS

| | | | |
|---|---|---|---|
| DE | 597726 | C | 5/1934 |
| DE | 660884 | C | 6/1938 |
| DE | 1032771 | B | 6/1958 |
| DE | 19620068 | C1 | 5/1997 |
| DE | 102018116201 | A1 | 1/2020 |
| EP | 0446777 | A1 | 9/1991 |

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

A catching device for a shunting coupling has a catching body with an end stop, a right-hand side lateral stop, and a left-hand side lateral stop that together form a holding body with an inner region delimited on three sides and an open side. The open side can be closed by a lock and the open side is dimensioned such that a specified shunting coupling can be moved into the inner region through the open side. The catching device has at least one elastic and/or elastically mounted stop element on one of the stops. There is also described a rail vehicle with such a catching device and also a method for locking a shunting coupling.

19 Claims, 3 Drawing Sheets

CATCHING DEVICE FOR A SHUNT COUPLING

FIELD AND BACKGROUND OF THE INVENTION

The invention relates to a catching device for a shunt coupling, in particular with reduced transverse play and a spring-loaded stop. The invention further comprises a rail vehicle having such a catching device and a method for latching a shunt coupling.

For the purpose of using shunt couplings, e.g. an RK 900 shunt coupling, on a rail vehicle, a catching device is generally present and usually also mandatory on this rail vehicle. Such a catching device can secure or latch the shunt coupling in a park position. For this purpose, the shunt coupling is generally pivoted from the shunt position (horizontal orientation of the shunt coupling) upward to the park position (vertical orientation of the shunt coupling) for this purpose.

The shunt coupling is usually pivoted to the park position by means of a hydraulic or pneumatic lifting cylinder to which pressure is applied. As a result, the coupling pivots to a virtually vertical position. At an angle of approximately 80° with respect to the horizontal, a mechanical lock of the coupling latches in, but the shunt coupling should be pivoted yet further as far as 90° to the park position since otherwise, in the case of double traction, the respectively facing shunt couplings of the two shunting locomotives that are coupled to one another would bump into each other.

In the vertical position, the shunt coupling is additionally secured by means of a catching device. For this purpose, a securing element in the form of a bolt, a chain or the like is fitted. If required, the coupling is manually pushed backward for this purpose. The lifting cylinder may be vented again only after this securing.

When the shunt coupling is lowered from the park position to the shunt position, pressure is initially applied to the lifting cylinder again and the securing of the catching device is removed. The pressure in the lifting cylinder is then reduced and at the same time the coupling is mechanically unlocked, so that it can pivot downward due to the force of gravity.

Previous catching devices form a fixed stop for the shunt coupling in the park position and exhibit considerable transverse play. This transverse play has the disadvantageous result that the shunt coupling executes sharp and uncontrolled movements in the park position when the rail vehicle moves through bends with the screw coupling coupled. In this case, considerable shocks act on the catching device, and this can lead to deformation and damage to the catching device or the shunt coupling.

The fixed stop, in conjunction with the large amount of transverse play, can furthermore lead to the shunt coupling not being able to pivot securely from its vertical park position to the shunt position (ready-to-couple position). The coupling then remains in the park position in spite of being operated to be lowered and has to be manually struck from there. In case of vehicles with a transverse bridge, the operator can go up and hit the coupling in order to cause lowering. In the case of vehicles without a transverse bridge, this is not possible, and therefore the coupling can be manually struck only from below (e.g. from the Berner rectangle). This presents a considerable hazard for the operator.

SUMMARY OF THE INVENTION

The object of the present invention is to specify an alternative, more convenient catching device and a method for latching a shunt coupling having such a catching device, with which device the advantages described above are avoided and in particular secure holding and lowering of a shunt coupling is ensured.

This object is achieved by a catching device as claimed, a rail vehicle as claimed and a method as claimed.

A catching device according to the invention for a shunt coupling comprises a catching body with an end stop, a right-hand-side lateral stop and a left-hand-side lateral stop which together form a holding body which has an inner region delimited on three sides (by the stops) and which has one side that is open but can be locked by a lock, said open side being dimensioned such that a predefined shunt coupling can be moved into the inner region through the open side.

To date, such a catching device has been known from the prior art (see e.g. FIG. 1). The catching device has three closed sides and one open side (for inserting the shunt coupling) and preferably has an, in particular angled, U-shaped profile.

When this catching device is arranged on a shunt locomotive as intended, the end stop is located on the locomotive-side portion of the inner region. When a shunt coupling is received by the catching device, the lock of the open side is initially open and is then closed by the lock in order to prevent the shunt coupling from falling out of the park position. It goes without saying that the open side has to be large enough that the shunt coupling fits through in order to be received by the catching device in the first place. Although the shunt coupling is not part of the catching device, its known dimensions are used for dimensioning the catching device. The passage "that a predefined shunt coupling can be moved into the inner region through the open side" therefore merely means that the open side has a predefined extent, this corresponding to the already known thickness or the already known circumference of a predetermined shunt coupling.

The dimensioning of the open side can also be specified in absolute terms by at least 100 mm, in particular at least 150 mm. Since customary shunt couplings at the point in question rarely have a diameter of more than 400 mm, the maximum extent for the dimensioning is preferably less than 500 mm, in particular less than 300 mm.

According to the invention, the catching device has at least one elastic and/or elastically mounted stop element on one of the stops (that is to say the end stop and/or at least one of the lateral stops). Owing to these stop elements, a shunt coupling introduced into the interior has considerably reduced play in comparison to previous catching devices. Therefore, a movement of a shunt coupling in the catching device can be reduced to a minimum, as is discussed in more detail below. The passage "elastic and/or elastically mounted stop element" means that the stop element itself can be elastic, or the stop element can be inelastic but is then elastically mounted or that the stop element is elastic and additionally can be elastically mounted.

A rail vehicle according to the invention is, in particular, a shunt locomotive and comprises a catching device according to the invention (at the location of a conventional catching device).

In a method according to the invention for latching a shunt coupling in a catching device according to the invention, the catching device corresponds to a preferred embodiment in which the end stop is equipped with an elastically mounted stop element which is configured such that it can push a shunt coupling beyond the lock (of course only when this lock is open) through the open side of the catching device. The method comprises the following steps:

- tilting the shunt coupling from a shunt position to a park position by means of a lifting cylinder,
- receiving the shunt coupling in the inner region of the catching device,
- pushing in the stop element on the end stop against a spring force of its elastic mounting with the shunt coupling,
- closing the lock of the open side, so that the shunt coupling is pushed against the lock by the spring force of the elastically mounted stop element.

The stop element on the end stop therefore ensures mechanical tensioning with which the shunt coupling is pushed against the lock in the catching device. If the lock is now opened again, the spring-mounted stop element pushes the shunt coupling slightly beyond the point of locking through the open side. This spares manual movement of the shunt coupling from the park position, this being highly advantageous for safety while working.

It should be noted that the shunt coupling (which, as stated, is not part of the invention) has long been known in the prior art. It has the conventional components, in particular a lifting cylinder. On account of the lack of a lever effect, the lifting cylinder is often not able to move the shunt coupling from the park position (90° with respect to the shunt position), but rather requires a slight inclination of the shunt coupling with respect to the vertical (e.g. 85°). In order to move the shunt coupling to this point, it was previously moved manually in the prior art, as was stated above. The invention allows, by way of the spring-mounted stop element on the end stop, "automated" movement of the shunt coupling if this had been moved to the park position in accordance with the method according to the invention. It should further be noted that, according to the specifications of the prior art, pressure always has to be applied to the lifting cylinder during lowering of the shunt coupling. The shunt coupling does not tilt out of the park position to the shunt position, but rather is tilted from the (vertical) park position merely to the virtually vertical position (in accordance with the method according to the invention by the spring-action stop rather than manually), so that the lifting cylinder has an effective lever for movement of the shunt.

Further, particularly advantageous refinements and developments of the invention can be found in the dependent claims and in the following description, with the claims of one claims category also being able to be developed analogously to the claims and parts of the description relating to another claims category and in particular individual features of different exemplary embodiments or variants also being able to be combined to form new exemplary embodiments or variants.

In a preferred catching device, at least one stop element comprises an elastic buffer element. This buffer element has a modulus of elasticity of greater than 0.05 GPa and less than 10 GPa. The modulus of elasticity of the buffer element is preferably less than 6 GPa and/or greater than 0.1 GPa.

Preferred materials from which a buffer element can be manufactured are elastomers, e.g. rubber or silicone (individually or in combination), but springs composed of steel or plastic, e.g. helical or leaf springs, can also be used.

According to a preferred embodiment of the catching device, at least one stop element, preferably at least the end stop, is elastically mounted by means of a spring or an elastic buffer element (as described above). This mounting is preferably configured such that a shunt coupling located in the inner region of the catching device can be (at least partially) pushed out of the inner region through the open side. If the catching device is attached to a rail vehicle, the stop element in question is preferably configured (and the catching device attached) such that a shunt coupling can be pushed out of a park position by the spring-mounted stop element at an inclination angle of less than 87° with respect to the horizontal, in particular less than 85°, or even less than 80°, with respect to the horizontal.

According to a preferred embodiment of the catching device, a movement of the elastically mounted stop element is guided in the direction of the spring force of the spring or the elastic buffer element by means of a guide element. This has the advantage that tilting of the stop element and therefore blocking of the movement is prevented.

It is preferred here for at least one of the guide elements to be arranged next to the spring or the elastic buffer element. As an alternative or in addition, at least one of the guide elements is surrounded by a spring. Therefore, e.g. spring-action bolts for guiding and/or at the same time elastically mounting the stop element can be ensured. However, secure guiding can also be achieved by guide elements which are provided independently of the spring-action mounting.

According to a preferred embodiment of the catching device, both the right-hand-side lateral stop and the left-hand-side lateral stop each have an elastic stop element. The stop elements preferably lie opposite each other on a line, this having the particular advantage that no oblique moment of force acts on a shunt coupling owing to the stop elements. The stop elements are particularly preferably arranged such that they hold a shunt coupling on the right and left in a positively locking manner. Therefore, the shunt coupling should not have any play to the right and left, but rather be held fixedly between the stop elements. Sliding backward and forward (toward the end stop or away from it) should however preferably be possible since an elastically mounted stop element as described above can (at least partially) push the coupling out of the catching device.

According to a preferred embodiment, the catching device comprises a lock which is formed such that it can close the open side of the catching body, wherein the lock preferably comprises a bolt and/or a chain. A combination of a bolt and chain is preferred here since this ensures particularly secure locking. The lock particularly preferably has an (in particular elastic) element for protecting other elements of the lock and the shunt coupling. In particular, the bolt is surrounded by an elastic protective layer or at least a protective layer composed of plastic. This protects the bolt from movements of the shunt coupling during travel of a rail vehicle and of course also protects the shunt coupling.

According to a preferred embodiment of the catching device, a portion of a stop element that is averted from the respective stop has a spherical form, that is to say e.g. the form of a hemisphere. A stop element is preferably in the form of a hemisphere fitted on a cylindrical base here. However, a stop element can also simply be in the form of an elastic panel.

According to a preferred embodiment of the catching device, at least one stop element is screwed to the catching device. A screw is preferably arranged centrally in the stop element here. However, as an alternative, a plurality of screws can also be arranged mirror-symmetrically with respect to a center plane or rotationally symmetrically with respect to the center point of the stop element.

According to a preferred embodiment of the catching device, an elastically mounted stop element is arranged on the end stop, the spring-action movement of the elastically mounted stop element preferably being guided by means of guide elements. The stop element, on its side facing the inner region, preferably additionally has an (elastic) buffer element. Here, the stop element is elastically mounted on the end stop in such a way that it can push a predetermined shunt coupling out of a park position when a lock of the catching device is opened. The rear stop for a shunt coupling (end stop) is therefore designed to be elastically movable, as already described above. The shunt coupling is pivoted to the park position against this spring-loaded stop. During lowering, the spring force of the stop element causes the shunt coupling to be reliably pushed out of the park position.

Advantages of the invention in comparison to customary catching devices with a large amount of transverse play and a fixed stop are that the transverse movement of the shunt coupling to the park position can be reduced to a minimum with the catching device according to the invention. As a result, the mechanical loads on the catching device itself are considerably reduced. Furthermore, it is possible for the shunt coupling to be able to be securely pivoted downward out of the park position to a ready-to-couple position (shunt position).

The invention will be explained once again in more detail below with reference to the attached drawings using exemplary embodiments. In this case, the same components have been provided with identical reference numerals in the various figures. The drawings are generally not true to scale and in the drawings:

DETAILED DESCRIPTION OF THE INVENTION

Figure 1:
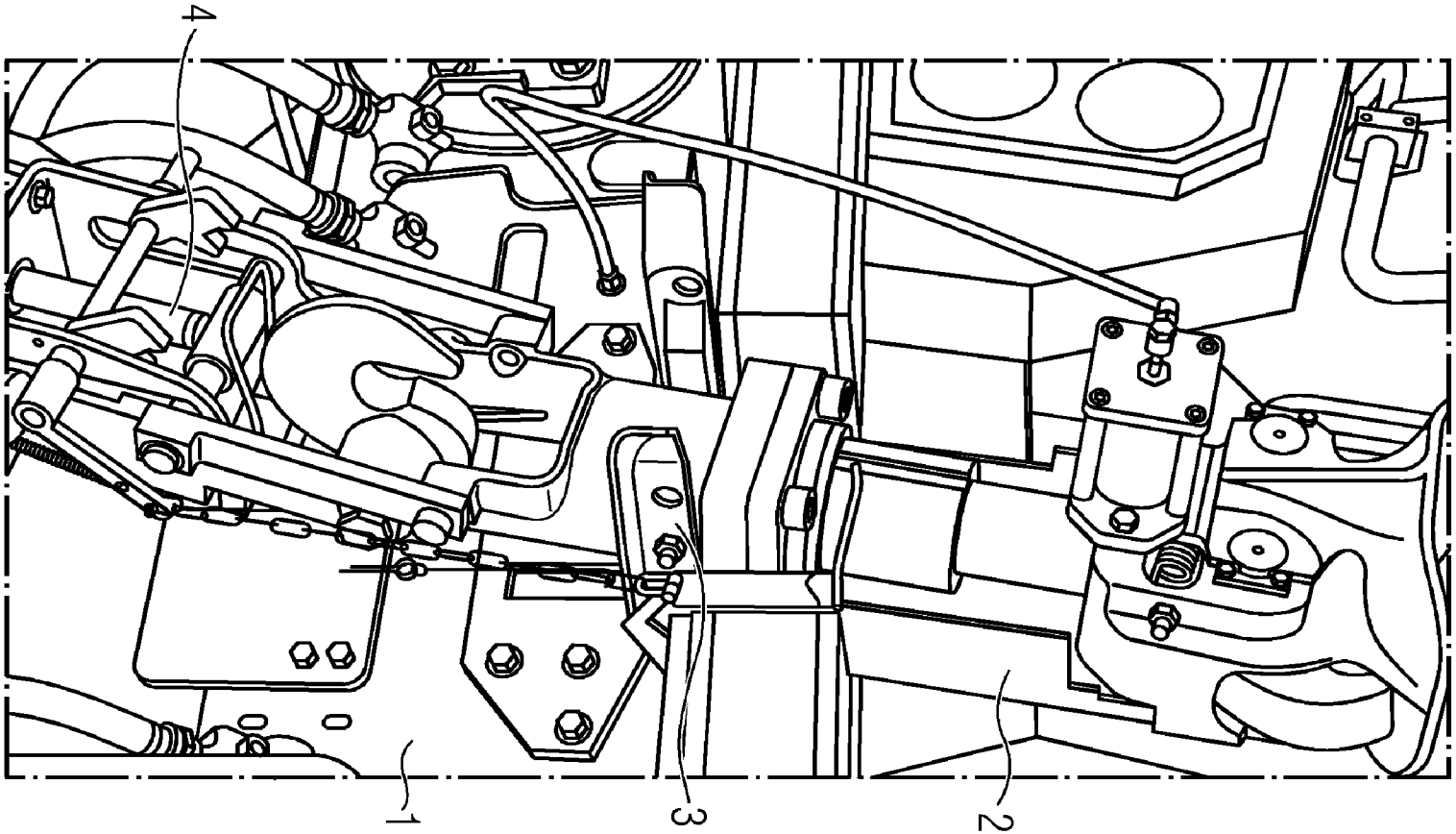
FIG. 1 shows a rail vehicle having a shunt coupling in a catching device according to the prior art.

FIG. 1 shows a rail vehicle 1, here the front section of a shunting locomotive, having a shunt coupling 2 in a catching device 3 according to the prior art. The shunt coupling 2 is in the park position here, i.e. tilted upward through 90° in comparison with the shunt position. In this park position, two shunting locomotives can also be coupled together without the shunt couplings 2 of the shunting locomotives bumping into each other during travel. As can be seen, the shunt coupling 2 is tilted in a somewhat inclined manner with respect to the side of the locomotive (on the right in the figure). It can be clearly seen that the shunt coupling 2 has a certain amount of play on the other side of the catching device 3, and therefore it could also be tilted in an inclined manner to the other side. This happens if the rail vehicle with the shunt coupling 2 in the park position were to travel around a bend.

Figure 2:
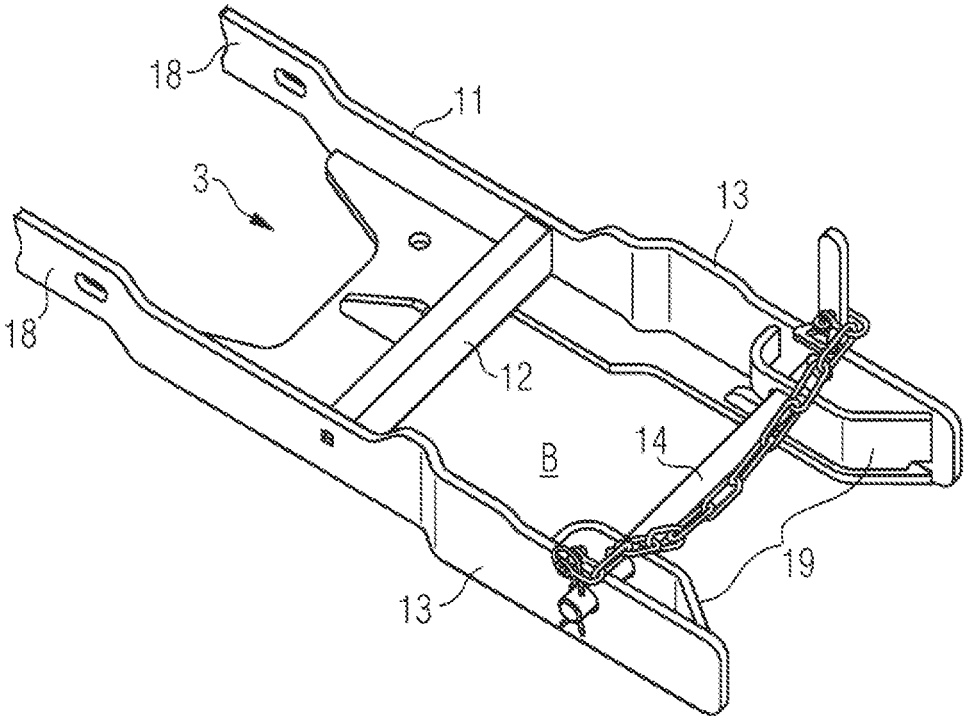
FIG 2 Prior art
FIG. 2 shows a catching device according to the prior art.

FIG. 2 shows a catching device 3 according to the prior art. Here, the catching device 10 has a catching body 11 which is composed of steel, has an end stop 12 on the locomotive side (to the back left) and has a side stop 13 on either side, so that an angled U-shaped profile with an inner region B is created. In order to prevent the shunt coupling 2 from tilting out in the park position (see FIG. 1), a lock 14 in the form of a bolt and a chain is arranged (for security) at a distance from the end stop 12 between the two side stops 13. For better insertion of a shunt coupling 2 into the inner region B, the ends of the side stops 13 are formed as oblique guides 19 which form a funnel. A portion of the catching body 11, which is designed in the form of a fastening 18, can be seen on the left, this fastening serving to attach the catching device 3 to a rail vehicle 1.

Figure 3:
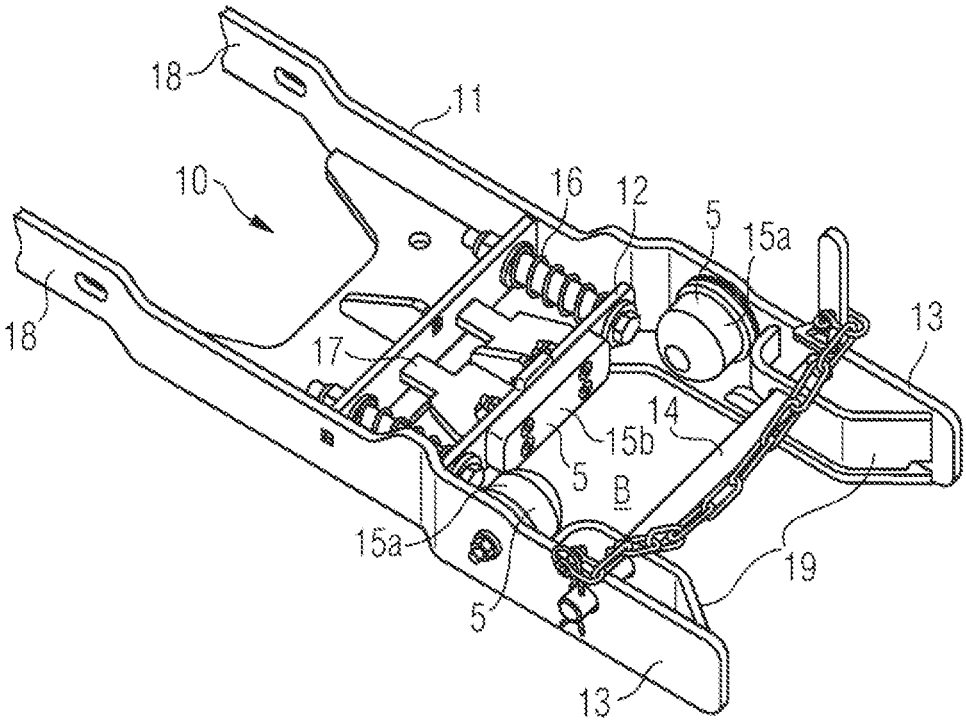
FIG. 3 shows an exemplary embodiment of a catching device according to the invention.

FIG. 3 shows an exemplary embodiment of a catching device 10 according to the invention. This catching device looks similar to the catching device 3 according to the prior art and also has the components shown in FIG. 2, but comprises further components which securely hold a shunt coupling in the park position and reduce the play of the shunt coupling to a minimum.

For this purpose, the catching device according to the invention comprises a stop element 15*b* on the end stop 12, the stop element here being provided with a spring 16 and a plate (e.g. composed of plastic, e.g. rubber) as the buffer element 5, and further stop elements 15*a*, which can be manufactured here e.g. as buffer elements 5 composed of rubber, on the two side stops 13. The stop elements 15*a* on the side stops 13 ensure that a shunt coupling 2 in the inner region B, that is to say in the park position (also see FIG. 4), cannot tilt to the left and right, but rather is always held upright.

The stop element 15*b* on the end stop 12 not only ensures that a shunt coupling is held in a positively locking manner, but also has a further, highly advantageous function. This can be derived from FIG. 4.

Figure 4:
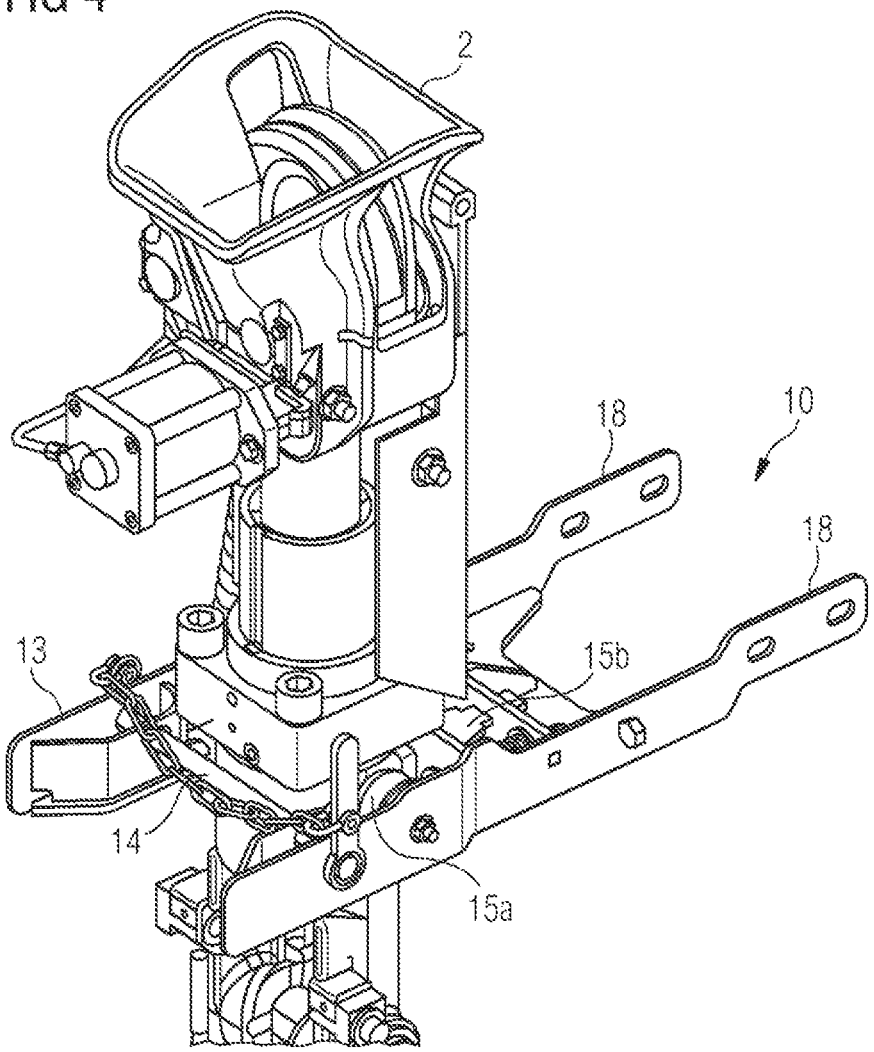
FIG. 4 shows a shunt coupling in a preferred catching device according to FIG. 3, and FIG. 5 schematically shows the course of a method according to the invention.

FIG. 4 shows a shunt coupling 2 in a park position in a preferred catching device 10 according to FIG. 3. As can be seen in FIG. 4, the stop element 15*b* on the end stop 12 is now shifted backward since it is pushed backward (in the direction of the fastening 18) by the shunt coupling. As a result, the shunt coupling 2 is not only pressed against the lock 14, which ensures good holding, but the shunt coupling 2 is also pushed forward by the springs 16 (see FIG. 3) after the lock 14 has opened, and therefore the shunt coupling no longer has to be moved out of the park position manually.

For interference-free movement of the stop element 15*b* on the end stop 12, two guide elements 17, wherein the screws on which the springs 16 are guided can also be considered to be guide elements 17.

The method according to the invention was used in order to reach this position.

Figure 5:
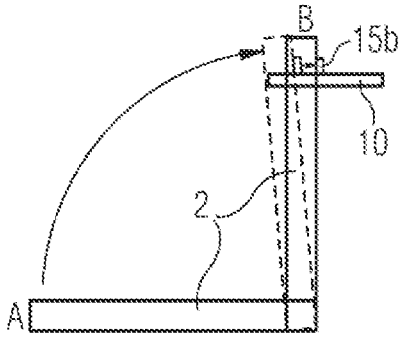

FIG. 5 schematically shows the course of a method according to the invention for latching the shunt coupling 2 in a catching device 10 as shown in FIG. 4.

The shunt coupling 2 is pushed from a shunt position A to a park position B by means of a lifting cylinder 4, the shunt coupling being moved into the inner region of the catching device 10 (bent arrow). Just before the park position is reached (indicated in dashed lines), it strikes against the stop element 15*b* on the end stop 12 (also see FIG. 3) and pushes the stop element against a spring force of its elastic mounting with the shunt coupling 2 backward (straight arrow). The lock 14 of the open side is then closed (see closed lock 14 of FIG. 3), so that the shunt coupling 2 is pushed against the lock 14 by the spring force of the elastically mounted stop element 15*b*.

Finally, it is pointed out once again that the embodiments described above in detail and the method are merely exemplary embodiments that can be modified by a person skilled in the art in a wide variety of ways without departing from the field of the invention. In addition, the use of the indefinite article "a" or "an" does not preclude the features in question from also being existent multiple times.

Similarly, the term "unit" does not preclude the components in question consisting of a plurality of interacting subcomponents that, if need be, may also be distributed in space.

The invention claimed is:

1. A catching device for a shunting coupling, the catching device comprising:

a catching body with an end stop, a right-hand-side lateral stop, and a left-hand-side lateral stop, with said end stop and said lateral stops together forming a holding body having an inner region delimited on three sides and having an open side;

the open side being dimensioned to allow a predefined shunting coupling to be moved into the inner region through the open side;

a lock configured for selectively locking the open side; and at least one stop element, being at least one of an elastic stop element or an elastically mounted stop element, disposed on one of said end stop or said lateral stops, said at least one stop element comprising an elastic buffer element which has a modulus of elasticity of greater than 0.05 Gpa and less than 10 Gpa.

2. The catching device according to claim 1, wherein the modulus of elasticity of said buffer element is less than 6 GPa and/or greater than 0.5 GPa.

3. The catching device according to claim 1, wherein said buffer element is made of rubber or silicone.

4. The catching device according to claim 1, wherein said at least one stop element is elastically mounted by way of a spring or an elastic buffer element.

5. The catching device according to claim 1, wherein said end stop is elastically mounted by way of a spring or an elastic buffer element.

6. The catching device according to claim 5, which comprises at least one guide element configured to guide a movement of said elastically mounted stop element in a direction of a spring force of said spring or said elastic buffer element.

7. The catching device according to claim 6, wherein said at least one guide element is arranged next to said spring or said elastic buffer element and/or said at least one guide element is surrounded by a spring.

8. The catching device according to claim 1, wherein each of said right-hand-side lateral stop and said left-hand-side lateral stop has an elastic stop element, and wherein said stop elements lie opposite each other along a line.

9. The catching device according to claim 8, wherein said elastic stop elements are disposed to hold a shunting coupling on a right side and a left side in a positively locking manner.

10. The catching device according to claim 1, wherein said lock is configured to close the open side of said catching body and said lock comprises at least one of a bolt or a chain.

11. The catching device according to claim 10, wherein said bolt is surrounded by an elastic protective layer or at least a protective layer composed of plastic.

12. The catching device according to claim 1, wherein a portion of a stop element that is averted from the respective stop has a spherical form.

13. The catching device according to claim 12, wherein said stop element comprises a hemisphere fitted on a cylindrical base.

14. The catching device according to claim 1, wherein at least one of said stop elements is screwed to the catching device, with a screw arranged centrally in said at least one stop element or a plurality of screws arranged mirror-symmetrically with respect to a center point of said at least one stop element.

15. The catching device according to claim 1, wherein:

said elastically mounted stop element is arranged on said end stop and a spring-action movement of said elastically mounted stop element is guided by guide elements; and said stop element is elastically mounted on the end stop to effectively push the predetermined shunting coupling out of a park position when said lock of the catching device is opened.

16. The catching device according to claim 15, wherein said elastically mounted stop element comprises a buffer element on a side facing the inner region.

17. A rail vehicle, comprising a catching device according to claim 1.

18. The rail vehicle according to claim 17 being a shunting locomotive.

19. A method for latching a shunting coupling, the method comprising:

providing a catching device according to claim 1 with an elastically mounted stop element on the end stop;

tilting the shunting coupling from a shunting position to a park position by a lifting cylinder;

receiving the shunting coupling in the inner region of the catching device;

pushing in the stop element on the end stop with the shunting coupling against a spring force of an elastic mounting of the elastically mounted stop element; and closing the lock of the open side, with the shunting coupling being pushed against the lock by the spring force of the elastically mounted stop element.

* * * * *